US007503132B2

(12) United States Patent
Mason

(10) Patent No.: US 7,503,132 B2
(45) Date of Patent: Mar. 17, 2009

(54) FOOT-WEARS, NAMELY SPORT FOOT-WEARS, AND PRODUCTION METHOD THEREOF

(75) Inventor: Angelo Mason, Caerano di San Marco (IT)

(73) Assignee: Diadora S.p.A., Caerano Di San Marco (Treviso) (IT)

( * ) Notice: Subject to any disclaimer, the term of this patent is extended or adjusted under 35 U.S.C. 154(b) by 559 days.

(21) Appl. No.: 10/500,636

(22) PCT Filed: Dec. 18, 2002

(86) PCT No.: PCT/IB02/05548

§ 371 (c)(1),
(2), (4) Date: Jan. 25, 2005

(87) PCT Pub. No.: WO03/055344

PCT Pub. Date: Jul. 10, 2003

(65) Prior Publication Data

US 2005/0120593 A1 Jun. 9, 2005

(30) Foreign Application Priority Data

Jan. 4, 2002 (IT) ..... TO2002A0010

(51) Int. Cl.
*A43B 13/18* (2006.01)

(52) U.S. Cl. ..... 36/76 R; 36/27; 36/103

(58) Field of Classification Search ..... 36/27, 36/28, 35 R, 31, 103, 76 R
See application file for complete search history.

(56) References Cited

U.S. PATENT DOCUMENTS

| | | | | | |
|---|---|---|---|---|---|
| 903,276 | A | * | 11/1908 | Edman | 36/72 R |
| 2,342,466 | A | * | 2/1944 | Gordon | 36/76 R |
| 4,360,978 | A | * | 11/1982 | Simpkins | 36/114 |
| 4,492,046 | A | * | 1/1985 | Kosova | 36/27 |
| 5,452,526 | A | | 9/1995 | Collins | |
| 5,517,769 | A | * | 5/1996 | Zhao | 36/27 |

FOREIGN PATENT DOCUMENTS

| | | | |
|---|---|---|---|
| DE | 295503 | C | 12/1916 |
| GB | 2 113 971 | A | 8/1993 |
| JP | 52-106948 | | 9/1977 |
| JP | 60-109406 | U | 7/1985 |
| JP | 5-84103 | | 4/1993 |

* cited by examiner

*Primary Examiner*—Jila M Mohandesi
(74) *Attorney, Agent, or Firm*—Sughrue Mion, PLLC

(57) ABSTRACT

The foot-wears according to the invention, in particular sport foot-wears, include a sole (3) of molded synthetic material, within which internal stiffening means (4) are provided. The stiffening means include at least an insert (4) of thread-like form, or anyway of thin and elongated form, defining a plurality of intermediate bends (4A); the intermediate bends (4A) define, along the development of the insert (4), two or more stretches (4B, 4D) which extend side by side in at least a zone of the sole (3); the stretches (4B, 4D) arranged side by side extend in a substantially longitudinal direction or in a transverse direction with respect to the sole (3), depending upon the type of stiffening which is desired for the aforesaid zone.

20 Claims, 6 Drawing Sheets

FOOT-WEARS, NAMELY SPORT FOOT-WEARS, AND PRODUCTION METHOD THEREOF

The present invention refers to the field of foot-wears, in particular sport foot-wears, and to a method for the production of foot-wears.

In order to comply with and improve the performances of some kinds of foot-wears (and namely those being used for sports like soccer, running, tennis) the use is known of soles made of synthetic material, which are stiffened in one or more respective areas.

At the present state of the art, the cited stiffening is obtained by providing more or less rigid inserts within the body of the sole, such inserts being made of synthetic material of the same type of the one used for molding the sole.

Said known solution, besides determining a certain increase of the overall weight of the sole, and therefore of the footwear, involves additional manufacturing costs, which are determined by the necessity of preventively mold the components of synthetic material destined to constitute the above cited inserts.

The mentioned prior art does present, above all, the drawback of causing breakings between the base body of the sole and the stiffening insert or inserts being envisaged.

The present invention has the aim of solving the aforesaid disadvantages.

Within this frame, an aim of the invention is that of obtaining foot-wears whose soles, even if lightweight and having the optimal degree of rigidity in the desired zones, result of more solid construction than those which can be obtained according to the present state of the art; a further aim of the invention is that of indicating a method that allows for manufacturing in a simple and cheap way such foot-wears.

These and still other aims, that will turn out mainly clear in the following, are attained according to the present invention by the foot-wears and the method for manufacturing foot-wears having the features of the annexed claims, which are to be meant as an integral part of the present description.

Further purposes, characteristics and advantages of the present invention will emerge clearly from the ensuing detailed description and from the annexed drawings, which are provided purely by way of explanatory and non-limiting example and in which.

Figure 1:
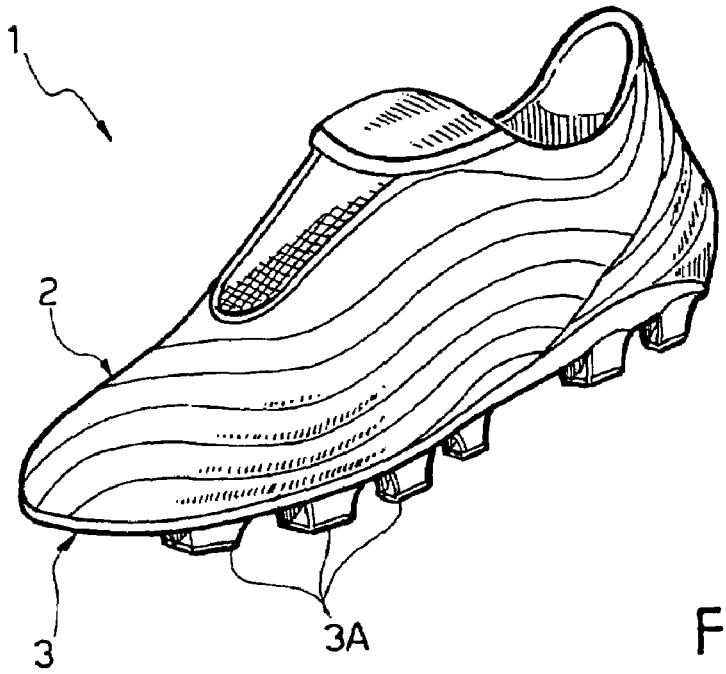
FIG. 1 represents a perspective view of a sport footwear obtained according to the present invention.

In FIG. 1, reference 1 indicates a footwear as a whole, of the type envisaged for playing soccer or football, the footwear 1 being manufactured according to the invention; footwear 1 comprises an upper 2 and a sole 3, which are mutually joined in a known manner, for example by sticking.

The way for manufacturing the upper 2 does not pertain to the purposes of the present invention, and consequently it will not be described and illustrated in detail. Sole 3 is made of synthetic material, such as polyurethane, and has a plurality of fixed studs 3Á.

According to the present invention, molding of sole 3 is performed such that, in the synthetic material constituting the sole, at least a metallic insert is drowned, being suitably shaped in order to confer a desired degree of rigidity to at least a zone of the sole 3, and eventually for guaranteeing, at the same time, a given degree of flexibility to at least another zone of the same sole.

Figure 2:
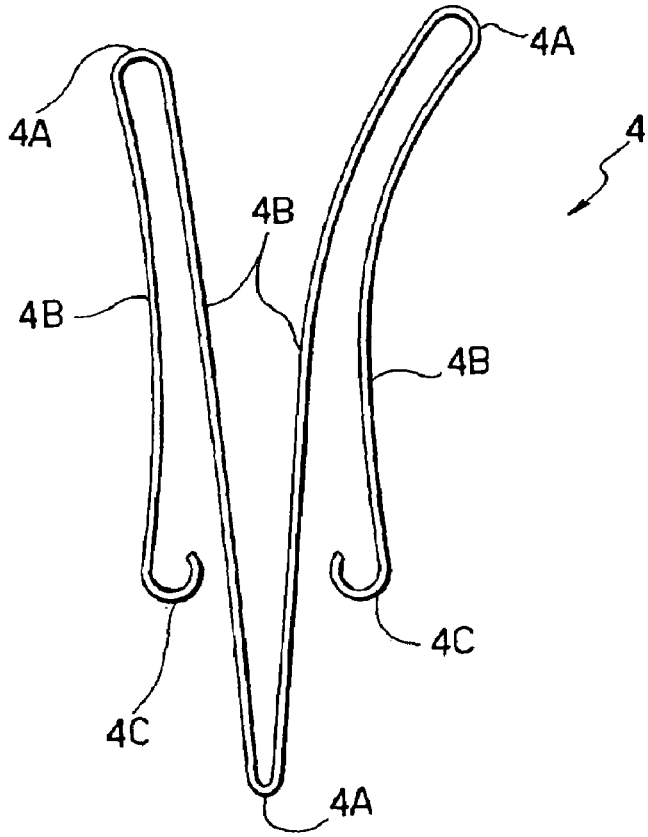
FIG. 2 represents a plan view of a member of the sole of the footwear of FIG. 1.

In FIG. 2 a first possible embodiment of the cited insert is represented, which is indicated with 4 as a whole; the insert 4 has a filiform or thread-like form, or anyway a thin and elongated form; to this purpose, insert 4 can be obtained starting from a usual wire, preferably made of steel.

As it can be noticed, along the development of the thread-like insert 4, a plurality of intermediate bends are defined, indicated with 4A, so as to form a plurality of substantially rectilinear stretches, indicated with 4B. In the case illustrated in FIG. 2, the insert 4 is provided with three intermediate bends 4A, so as to form four stretches 4B; in the exemplified case, moreover, also the longitudinal ends of the insert 4 has terminal bends 4C.

Figure 3:
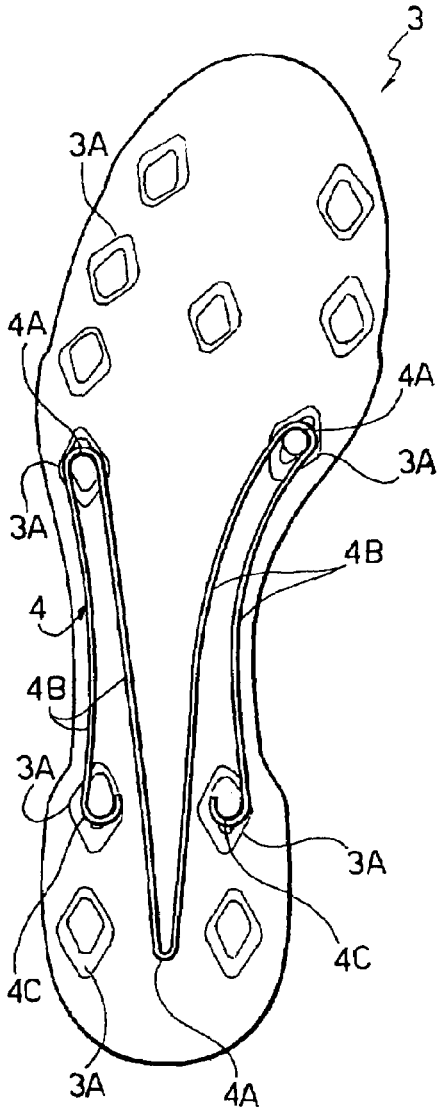
FIG. 3 represents a schematic longitudinal section of the sole of the footwear of FIG. 1.

In FIG. 3 a schematic section of sole 3 of footwear 1 of FIG. 1 is illustrated, in which there are also highlighted the positions of a number of fixed studs 3A.

As it can be noticed in such a figure, stretches 4B of the thread-like insert 4 extend mostly in the medial zone of sole 3, in the length direction of the latter and in side by side relationship; such an arrangement of the stretches 4B allows for providing the medial zone of sole 3, which has no studs, with an optimal rigidity in the lengthwise direction.

From FIG. 3 it is also possible to notice how nearly all the intermediate bends 4A and 4C of the insert 4 are positioned in correspondence of respective studs 3A of the sole 3, for the reasons that will be made clear in the following.

Figure 4:
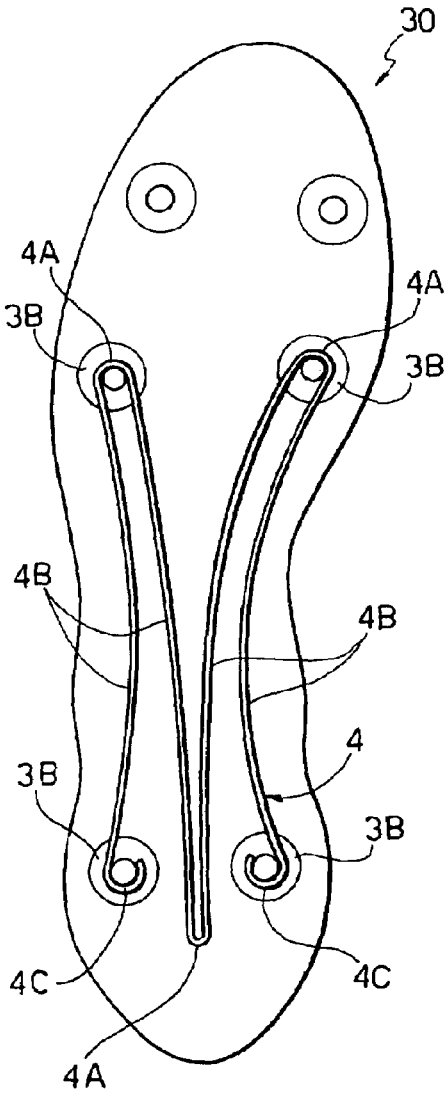
FIG. 4 represents a schematic longitudinal section of the sole of a footwear obtained according to a first possible variant embodiment of the invention.

In FIG. 4 a schematic section is represented of a sole 30 obtained according to a possible variant embodiment of the present invention, and namely a sole of the type being provided with metallic joints or connections 3B, each having a respective central threaded hole, within which there can be screwed a replaceable studs, of known construction, not represented here.

Within sole 30 of FIG. 4 there is integrated the same thread-like insert 4 as shown in FIG. 2; also in the case of the embodiment of FIG. 4 it is possible to notice how the main part of the intermediate and terminal bends 4A and 4C of insert 4 are positioned in correspondence of respective connections 3B of the sole 30; moreover, also in this case, the stretches 4A extend longitudinally and side by side in the medial zone of sole 30.

Figure 6:
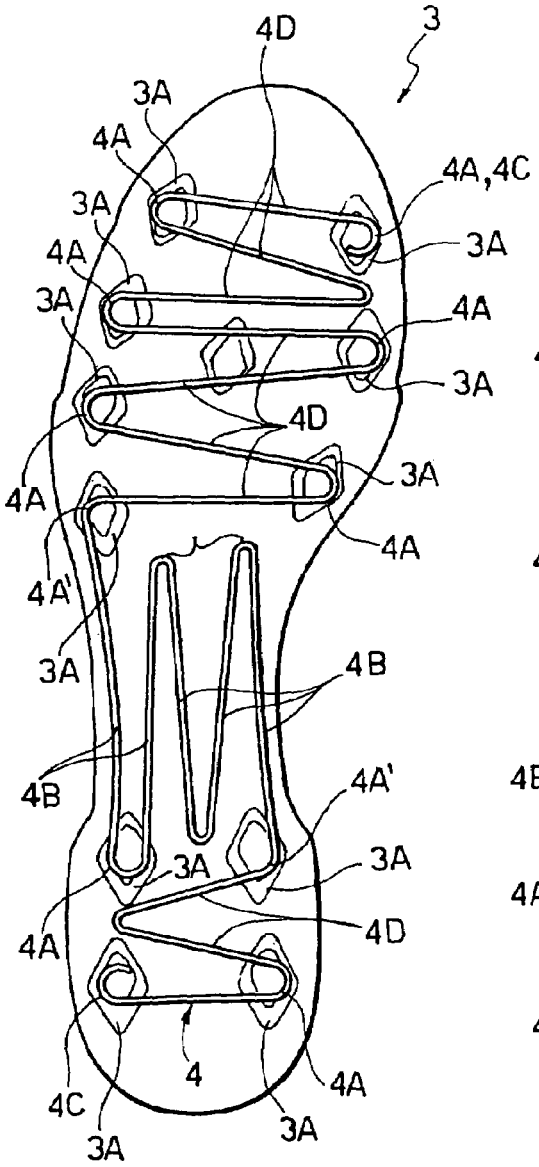
FIG. 6 represents a schematic longitudinal section of a sole incorporating the member of FIG. 5.
Figure 5:
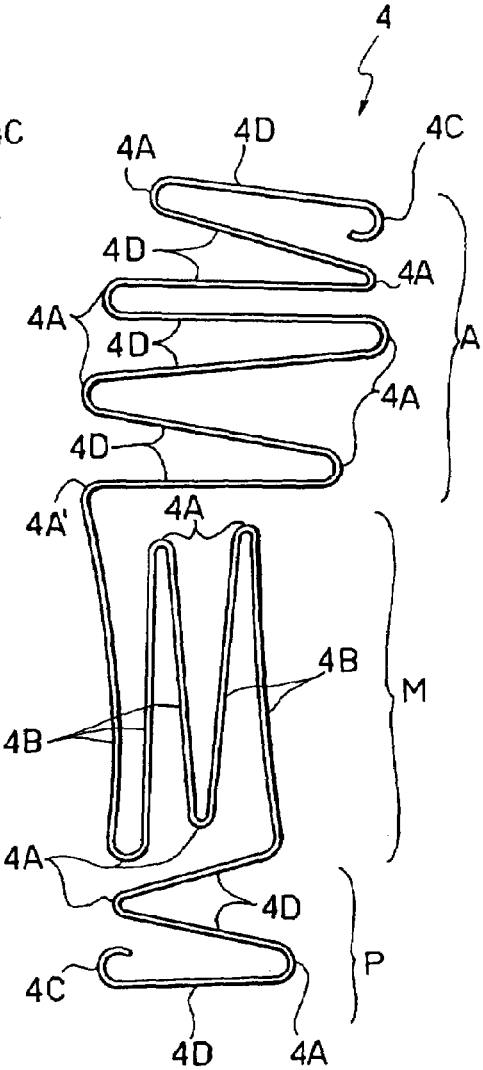
FIG. 5 represents a plan view of a member of the sole of a footwear obtained according to a second possible variant embodiment of the invention.

In FIG. 5 an alternative embodiment is represented, of a thread-like insert envisaged according to the invention, whereas FIG. 6 represents a sole 3 comprising such an insert. It should be appreciated that in such figures the same reference numbers of the previous figures are used, for indicating elements being technically equivalents to those previously mentioned.

In the thread-like insert 4 of FIG. 5 three zones or portions can be seen, indicated with P, M and A respectively. In portion P, besides an end bends 4C, the insert 4 has two intermediate bends 4A, to define three stretches 4D that extend substantially transversally to the longitudinal development of sole 3.

Portion P is followed, after an intermediate bend 4A' having a wide radius, by portion M, within which four intermediate bends 4A are provided, so as to define five stretches 4B that extend substantially longitudinally and side by side in the medial zone of sole 3.

Portion M is followed, after a new intermediate bend 4A' having a wide radius, by portion A; the latter has, besides an end bend 4C, six intermediate bends 4A, that define seven transversal stretches 4D.

As it can be perceived also from FIG. 6, portions P, M and A are provided for constituting stiffening means of the rear zone, the medial zone and the front zone of sole 3, respectively.

As to portion P and, above all, portion A of the thread-like insert 4 of FIG. 5, it has to be noticed how the arrangement of the stretches 4D allows for preventing transverse torsions of the respective zones of sole 3, however allowing the necessary flexibility of the same zones in the longitudinal direction.

In the specific case of foot-wears equipped with studs, each stretch 4D extends just between two points of the sole in correspondence of respective studs which are placed side by side in the transverse direction, so as to obtain stiffening bridges between said studs.

Also in the case being represented in FIG. 6, the main part of bends which are provided in the thread-like insert 4 are positioned in correspondence of respective studs 3A of sole 3.

Figure 8:
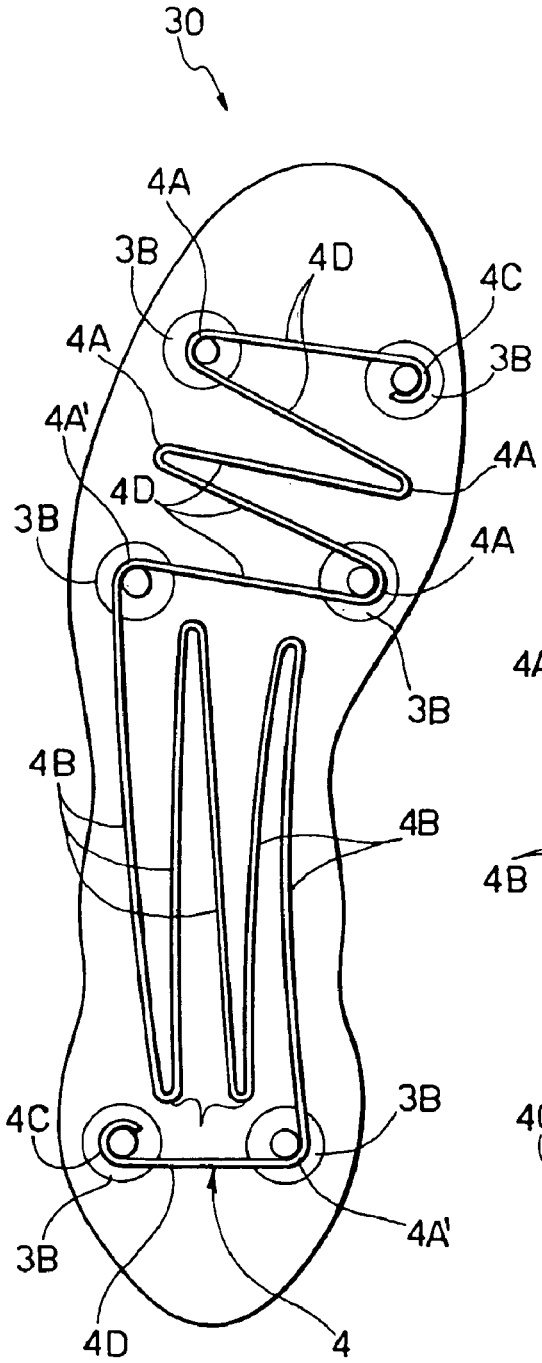
FIG. 8 represents a schematic longitudinal section of a sole incorporating the member of FIG. 7.
Figure 7:
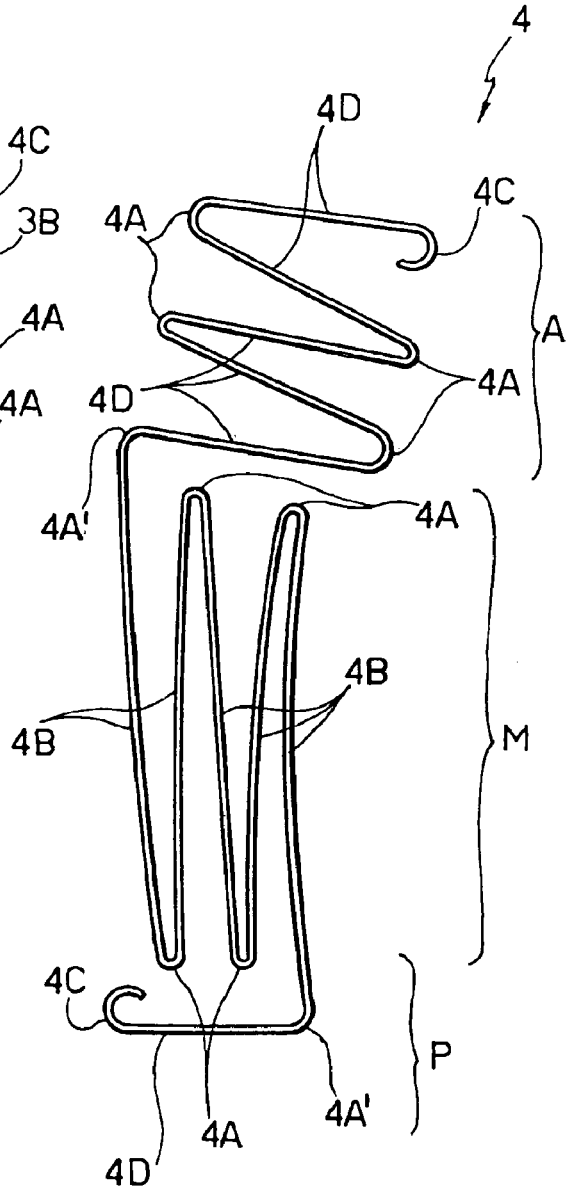
FIG. 7 represents a plan view of a member of the sole of a footwear obtained according to a third possible variant embodiment of the invention.

FIGS. 7 and 8 represent respectively a thread-like insert 4, being substantially similar to that one represented in FIG. 5, and a sole 30 equipped with such an insert; also in said figures the same reference numbers of the previous figures are used, for indicating elements being technically equivalents to those already described.

As it can be seen, the thread-like insert 4 of FIGS. 7 and 8 has a smaller number of intermediate bends 4A, with respect to the case of FIGS. 5 and 6, to define a more reduced number of transverse stretches 4D for the rear and front zones of sole 30.

Figure 10:
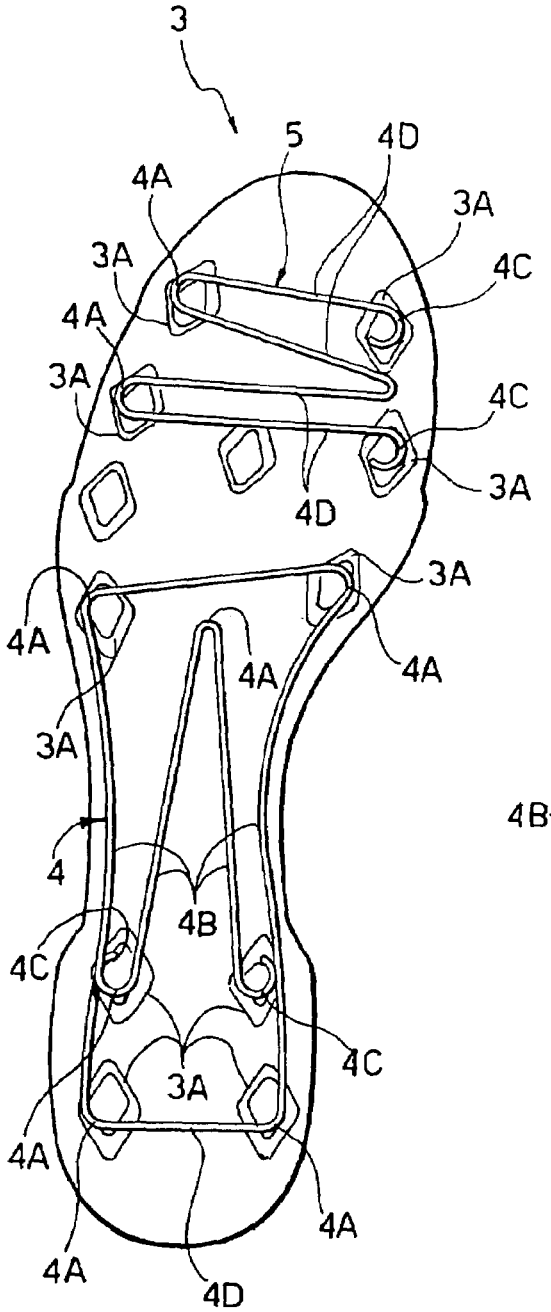
FIG. 10 represents a schematic longitudinal section of a sole incorporating the members of FIG. 9.
Figure 9:
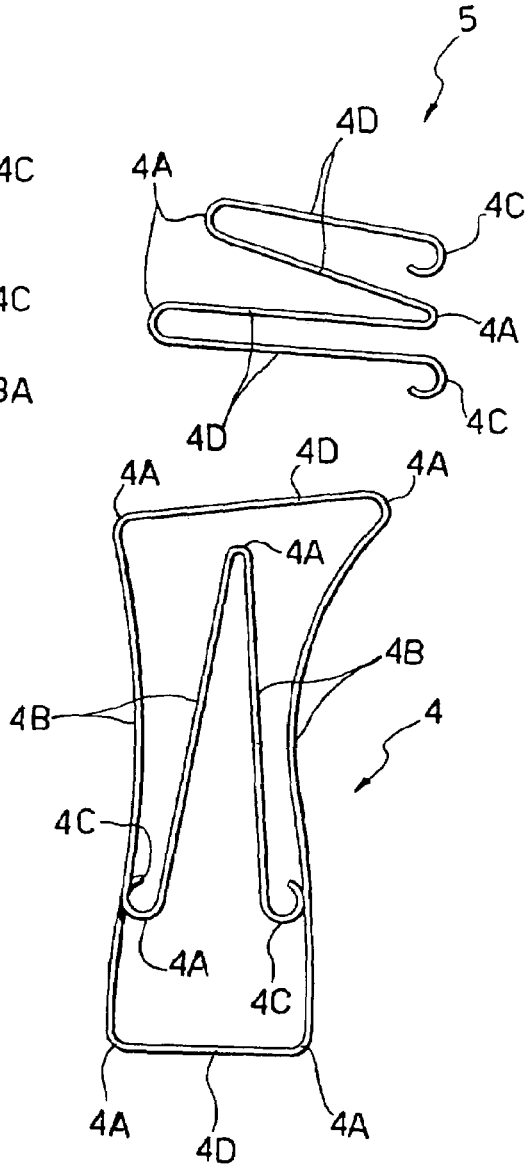
FIG. 9 represents a plan view of two members of the sole of a footwear obtained according to a fourth possible variant embodiment of the invention.

In the embodiment of the invention of FIGS. 9 and 10, a sole 3 is equipped with, besides an insert 4 for stiffening the medial zone, of a further and distinct insert 5 for stiffening the front zone of the sole.

Also in the case of the insert 4 of FIG. 9 there are provided, in addition to two end bends 4C, a series of intermediate bends 4A, some of which having a wide radius, which are envisaged for obtaining both a plurality of substantially longitudinal stretches 4B and two transverse end stretches 4D, which realize respective stiffening bridges between pairs of studs 3. On the other hand, insert 5 has, in addition to two end bends 4C, some intermediate bends 4C that define a series of stretches 4D extending transversally in the sole 3.

As it can be imagined, also in the case of the embodiment of FIGS. 9 and 10, the thread-like insert 5 allows for stiffening the front zone of sole 3 in the transverse direction, by means of the stretches 4D, however providing the same zone with the necessary flexibility in the longitudinal direction.

Figure 12:
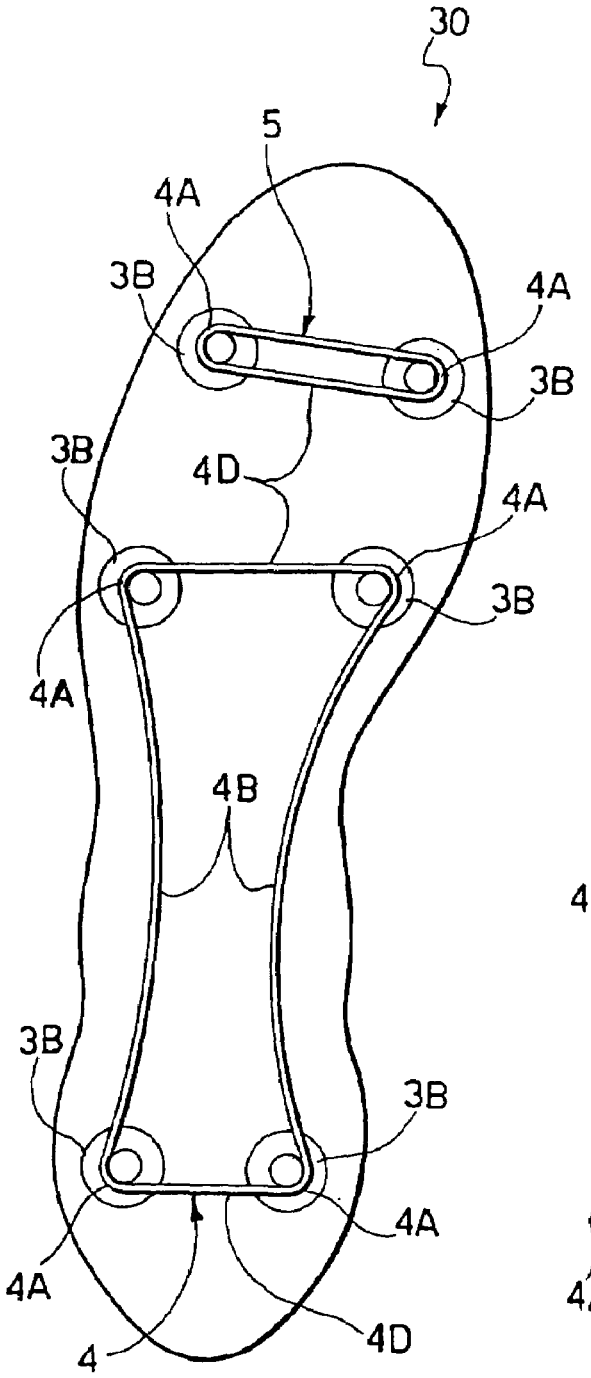
FIG. 12 represents a schematic longitudinal section of a sole incorporating the two members of FIG. 11.
Figure 11:
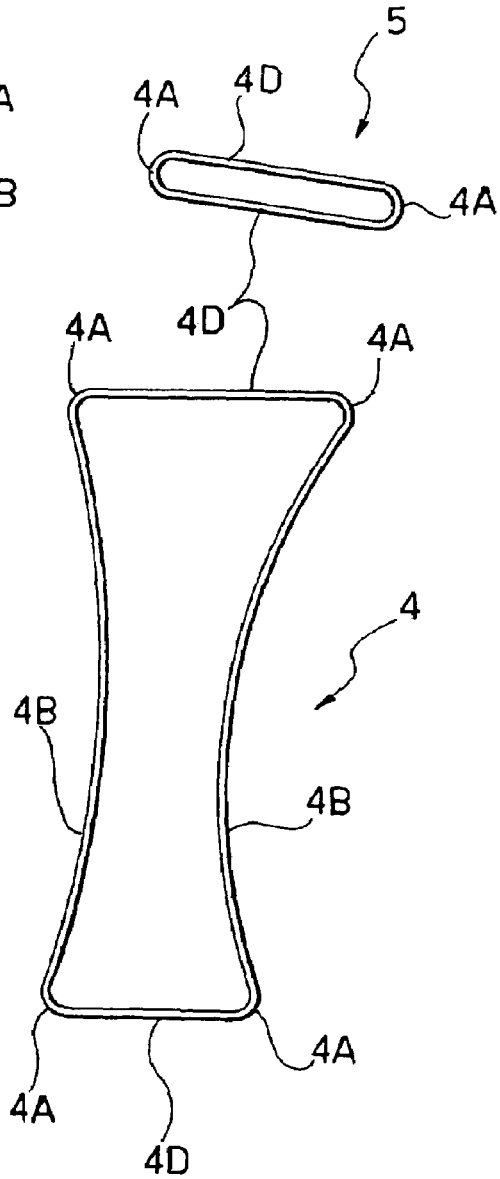
FIG. 11 represents a plan view of two members of the sole of a footwear obtained according to a fifth possible variant embodiment of the invention.

Also in the embodiment of FIGS. 11 and 12 there are provided:

- an insert 4, envisaged either for longitudinally stiffening the medial zone of sole 30, and for obtaining two transverse stiffening bridges for stud pairs adjacent to such a medial zone,
- a further and distinct transverse stiffening insert 5 for the front zone of sole 30, having the already mentioned purposes.

In the case represented in FIGS. 11 and 12, the development of the cited inserts 4 and 5 is closed, i.e., the inserts do not have respective ends. In such an embodiment, insert 4 has four intermediate bends 4A, to define two longitudinal stretches 4B and two transverse stretches 4D, while insert 5 has only two bends 4A, to define two transverse stretches 4D.

The manufacturing process of the soles pertaining to the foot-wears according to the invention is very simple, and is obtained by over-molding the body in synthetic material of the soles on the insert or inserts being envisaged.

To this purpose, a wire is worked with means in themselves known, in order to shape the insert 4, i.e., so as to present at least the intermediate bends 4A, between which the stretches 4B are defined side by side; the thus obtained insert 4 is then arranged within a mold envisaged for obtaining the sole 3 or 30, so that the cited stretches 4B arranged side by side are substantially positioned in the medial zone of the sole to be obtained, in the longitudinal direction of the latter.

Insert 5, if envisaged, is obtained with a technique similar to the one used for obtaining insert 4; said insert 5 is inserted within the cited mold in correspondence of the front zone of the sole to be obtained, and so as that its stretches 4D are arranged transversally with respect to the longitudinal development of the sole to be obtained.

If said sole is of the type equipped with studs, the insert 4, and the likely insert 5, is positioned within the mold in such a way that at least some of the respective bends 4A are arranged in correspondence of inner pins of the mold, envisaged for shaping the studs 3, or in correspondence of the threaded connections 3B, which can be already inserted at least partially in the mold; the presence of the mentioned pins or connections 3B allows for positioning with precision the insert 4 and/or 5 within the respective mold.

The synthetic or thermoplastic material is then injected within the mold, in order to form the sole, said operation being performed in a known manner.

It should be noticed that the inserts 4, 5 envisaged according to the invention can be obtained by means of the simple deformation of a thread-like element, and therefore in a faster and cheaper way than the molding of member in thermoplastic material as in the prior art; the production starting from a thread-like element also allows for obtaining, in a simple and quick way, inserts 4, 5 of any shape.

In the examples previously described the inserts 4 and 5 are integrated in a lower sole, i.e., the part of the footwear destined to rest directly on the ground; the invention is however directly applicable also for obtaining intermediate soles or insoles.

From the given description the characteristics of the foot-wears according to the present invention and the respective manufacturing method are clear, which characteristics are further detailed in the annexed claims.

From the given description also the advantages of the invention are clear. In particular it has to be emphasized that the soles of the described foot-wears turn out of simple and cheap manufacturing, of reduced weight, even if they are structurally more solid than those obtainable according to the prior art, endowed of the desired degree of rigidity in the medial zone.

Naturally, the principle of the invention being understood, the constructional details and forms of embodiment could be extensively changed with respect to that described and illustrated, by way of example, without leaving the scope of this invention as defined by the enclosed claims.

Within this frame, it should be considered that the attached drawings are aimed at illustrating only some of the several possible embodiments of the invention; the thickness, the material and the configuration of the envisaged thread-like inserts might therefore differ in function of the requirements, based on the specific foot-wears studied for any sport discipline or for different uses (i.e., not for sport).

The invention claimed is

1. A foot-wear comprising a sole (3; 30) made of synthetic material, the sole (3; 30) having a rearfoot region, a forefoot region and a instep region between the rearfoot and the forefoot regions, each of said regions having two respective lateral portions and one medial portion between the lateral portions, each of said portions extending in a longitudinal direction of the sole (3; 30);

sole stiffening means comprising a one-piece insert consisting of a wire member (4) having a length and being shaped to define a first end portion (A) of the insert, a second end portion (P) of the insert and an intermediate portion (M) of the insert between the first and second end portions thereof (A, P), the wire member (4) having a plurality of intermediate bends (4A) to define a plurality of wire portions (4B, 4D) along the length of the wire member (4);

wherein the intermediate portion (M) of the insert includes a plurality of first intermediate bends (4A) of the wire member (4) to define at least one pair of first wire portions (4B) arranged side by side in a transverse direction of the sole (3; 30), the first wire portions (4B) of the respective pair being consecutive and separated from each other by a respective one of said first intermediate bends (4A), the first wire portions (4B) extending in the medial portion of said instep region of the sole (3; 30) in a substantially longitudinal direction of the sole (3; 30); and wherein the first end portion (A) of the insert includes a plurality of second intermediate bends (4A) of the wire member (4) to define at least one pair of second wire portions (4D) arranged side by side in longitudinal direction of the sole (3; 30), the second wire portions (4D) of the respective pair being consecutive and separated from each other by a respective one of said second intermediate bends (4A), the second wire portions (4D) extending between the lateral portions of a respective one of said rearfoot and forefoot regions, to cross the medial portion thereof, in a substantially transverse direction of the sole (3; 30).

2. The foot-wear according to claim 1, wherein the first end portion (A) of the insert is at said forefoot region of the sole (3; 30) and the second end portion (P) of the insert is at said rearfoot region of the sole (3; 30), the second end portion (P) of the insert including at least one third wire portion (4D) extending between the lateral portions of said rearfoot region, to cross the medial portion thereof, in a substantially transverse direction of the sole (3; 30).

3. The foot-wear according to claim 1, wherein the sole (3; 30) has an outer peripheral edge and the insert does not extends beyond said edge.

4. The foot-wear according to claim 1, wherein the wire member (4) has two longitudinal ends, one end being at the first end portion (A) of the insert and the other end being at the second end portion (P) of the insert.

5. The foot-wear according to claim 1, wherein the wire member (4) has two longitudinal ends and has a respective bend (4C) at each of said ends.

6. The foot-wear according to claim 1, wherein the sole (3; 30) has lower studs (3A; 3B) and the insert is arranged such that a plurality of the bends (4A, 4C) of the wire member (4) are each at a position corresponding to a respective one of said studs (3A; 3B).

7. The foot-wear according to claim 1, wherein said first intermediate bends (4A) are substantially C-shaped or U-shaped bends or V-shaped.

8. The foot-wear according to claim 1, wherein said second intermediate bends (4A) are substantially C-shaped or U-shaped bends or V-shaped.

9. The foot-wear according to claim 1, wherein said first end portion (A) of the insert is at said forefoot region of the sole (3; 30) and includes at least four of said second intermediate bends (4A) of the wire member (4), to define at least five of said second wire portions (4D) forming four of said pairs, each of said at least four second wire portions (4D) extending between the lateral portions of said forefoot region, to cross the medial portion thereof, in a substantially transverse direction of the sole (3; 30).

10. The foot-wear according to claim 1, wherein said intermediate portion (M) of the insert includes two of said first intermediate bends (4A) of the wire member (4), to define at least three of said first wire portions (4B) forming two of said pairs, each of said first wire portions (4B) extending in the medial portion of the instep region of the sole (3; 30) in a substantially longitudinal direction of the sole (3; 30).

11. The foot-wear according to claim 2, wherein said second end portion (P) of the insert includes a single said third wire portion (4D) extending between the lateral portions of said rearfoot region, to cross the medial portion thereof, in a substantially transverse direction of the sole (3; 30).

12. The foot-wear according to claim 1, wherein the wire member (4) is a metal wire.

13. The foot-wear according to claim 1, wherein said second wire portions (4B) are substantially rectilinear.

14. The foot-wear according to claim 1, wherein said first wire portions (4B) are substantially rectilinear.

15. The foot-wear according to claim 2, wherein said at least one third wire portion (4B) is substantially rectilinear.

16. The foot-wear according to claim 1, wherein the sole (3; 30) is a lower sole of the foot-wear.

17. The foot-wear according to claim 1, wherein the sole (3; 30) is an intermediate sole of the foot-wear.

18. A foot-wear comprising a sole (3; 30) made of synthetic material, the sole (3; 30) having a rearfoot region, a forefoot region and an instep region between the rearfoot and the forefoot regions, each of said regions having two respective lateral portions and one medial portion between the lateral portions, each of said portions extending in a longitudinal direction of the sole (3; 30);

sole stiffening means comprising a one-piece insert consisting of a wire member (4) having a length and being shaped to define a first end portion (A) of the insert, a second end portion (P) of the insert and an intermediate portion (M) of the insert between the first and second end portions thereof (A, P), the wire member (4) having a plurality of bends (4A) to define a plurality of wire portions (4B, 4D) along the length thereof;

wherein the intermediate portion (M) of the insert includes a plurality of first intermediate bends (4A) of the wire member (4) to define at least one pair of first wire portions (4B) arranged side by side in a transverse direction of the sole (3; 30), the first wire portions (4B) of the respective pair being consecutive and separated from each other by a respective one of said first intermediate bends (4A), the first wire portions (4B) extending in the medial portion of said instep region of the sole (3; 30) in a substantially longitudinal direction of the sole (3; 30);

wherein the first end portion (A) of the insert includes a plurality of second intermediate bends (4A) of the wire member (4) to define at least one pair of second wire portions (4D) arranged side by side in a longitudinal direction of the sole (3; 30), the second wire portions (4D) of the respective pair being consecutive and separated from each other by a respective one of said second intermediate bends (4A), the second wire portions (4D) extending side by side between the lateral portions of said forefoot region, to cross the medial portion thereof, in a substantially transverse direction of the sole (3; 30); and wherein the second end portion (P) of the insert is at said rearfoot region of the sole (3; 30) and included at least one third wire portion (4D) extending between the lateral portions of said rearfoot region, to cross the medial portion thereof, in a substantially transverse direction of the sole (3; 30).

19. The foot-wear according to claim 18, wherein said second intermediate bends (4A) are substantially C-shaped or U-shaped bends or V-shaped.

20. The foot-wear according to claim 19, wherein the sole (3; 30) has an outer peripheral edge and the insert does not extends beyond said edge.

* * * * *